US006149407A

United States Patent [19]

Laing

[11] Patent Number: 6,149,407

[45] Date of Patent: Nov. 21, 2000

[54] GAS-VENTING DOMESTIC HOT WATER CIRCULATION PUMP

[76] Inventor: Karsten Laing, 1253 La Jolla Rancho Rd., La Jolla, Calif. 92037

[21] Appl. No.: 09/317,732

[22] Filed: May 24, 1999

[30] Foreign Application Priority Data

May 20, 1998 [DE] Germany ..... 198 22 704

[51] Int. Cl.[7] ..... F04B 17/00; F04B 35/04

[52] U.S. Cl. ..... 417/423.14; 417/420; 417/424; 96/166; 96/174

[58] Field of Search ..... 415/47, 131, 111, 415/168.1; 417/363, 420, 424, 423.14, 423.13, 423.3, 366, 423.12; 137/565, 338; 96/174, 166; 237/60; 310/43; 122/406.1, 13.1

[56] References Cited

U.S. PATENT DOCUMENTS

| | | | |
|---|---|---|---|
| 3,582,229 | 6/1971 | Von Fellenberg | 415/47 |
| 3,604,820 | 9/1971 | Scheller et al. | 417/363 |
| 3,664,373 | 5/1972 | Schichl | 137/565 |
| 3,767,330 | 10/1973 | Signorille | 417/420 |
| 4,172,695 | 10/1979 | Uesugi | 417/424 |
| 4,392,777 | 7/1983 | Huttlin | 415/131 |
| 4,456,456 | 6/1984 | Pompei | 96/174 |
| 4,555,253 | 11/1985 | Hull et al. | 96/166 |
| 4,878,804 | 11/1989 | Akerman et al. | 415/111 |
| 4,886,430 | 12/1989 | Veronesi et al. | 417/423.13 |
| 4,934,914 | 6/1990 | Kobayashi et al. | 417/423.3 |
| 4,979,875 | 12/1990 | Muller et al. | 415/168.1 |
| 5,033,673 | 7/1991 | Matsumoto | 237/60 |
| 5,624,244 | 4/1997 | Moon | 417/366 |
| 5,644,178 | 7/1997 | Halm | 310/43 |
| 5,692,886 | 12/1997 | Kobayashi et al. | 417/423.12 |
| 5,983,922 | 11/1999 | Laing et al. | 137/338 |
| 5,988,118 | 11/1999 | Park | 122/406.1 |
| 6,041,742 | 3/2000 | Drake | 122/13.1 |
| 6,065,946 | 5/2000 | Lathrop | 417/423.14 |
| 6,082,976 | 7/2000 | Kempf | 417/423.14 |

*Primary Examiner*—Teresa Walberg
*Assistant Examiner*—Leonid Fastovsky

[57] ABSTRACT

When a hot water supply line has to be filled with hot water at all times it requires that the contents of the hot water supply line has to be returned to the hot water heater by a circulator pump. When gas-bubbles form in the hot water supply line, they tend to form a bubble in the suction area of the pump impeller, which leads to an interruption of the flow. In order to prevent this, a circulator pump is used which has a calming chamber in which some of the gases separate, the rest of the air is moved into the spiral channel around the impeller due to an eccentricity of the vortex inside of the impeller. Finally also this gas stream flows into the calming chamber from where the gases leave through a venting valve.

10 Claims, 1 Drawing Sheet

GAS-VENTING DOMESTIC HOT WATER CIRCULATION PUMP

The invention refers to a circulation pump for a domestic hot water installation.

When a faucet in the hot water supply line is opened, the pressure within said line drops due to the friction in the line whereby gas dissolved in the water is set free. Also, heat applied to the water leads to the formation of gas-bubbles. When these gas-bubbles travel through the hot water supply line into the pump, the water flow becomes blocked as soon as the air centripeting within the suction port of the pump impeller has reached the size of said suction port. This gas interrupts the water stream. Since these emitted gases tend to collect in the inlet region of the pump impeller, it leads to the water-lubricated bearing of the impeller running dry, causing high wear.

To avoid this interruption in the water flow, the invention shows means that cause the gas-bubbles to be conveyed to the pressure side of the pump.

According to the invention, the water enters a calming chamber positioned in the highest region of the pump and being connected to the inlet port. This calming chamber communicates with an air-venting valve. Through the calming chamber, the water flows towards the suction region of the pump impeller through a hole, positioned eccentrical to the axis of rotation. A vane, positioned next to this gap, extends into the center region of the impeller. The eccentric hole, in combination with said vane, causes the vortex inside of the impeller to move eccentrically to the axis of rotation, whereby the gas-bubbles reach the spiral channel around the impeller. These gas-bubbles flow through a narrow bore which connects the spiral channel with the calming chamber. From there they leave through the venting valve.

DESCRIPTION OF THE PREFERRED EMBODIMENTS

Figures 1, 2, 2A, 2B:
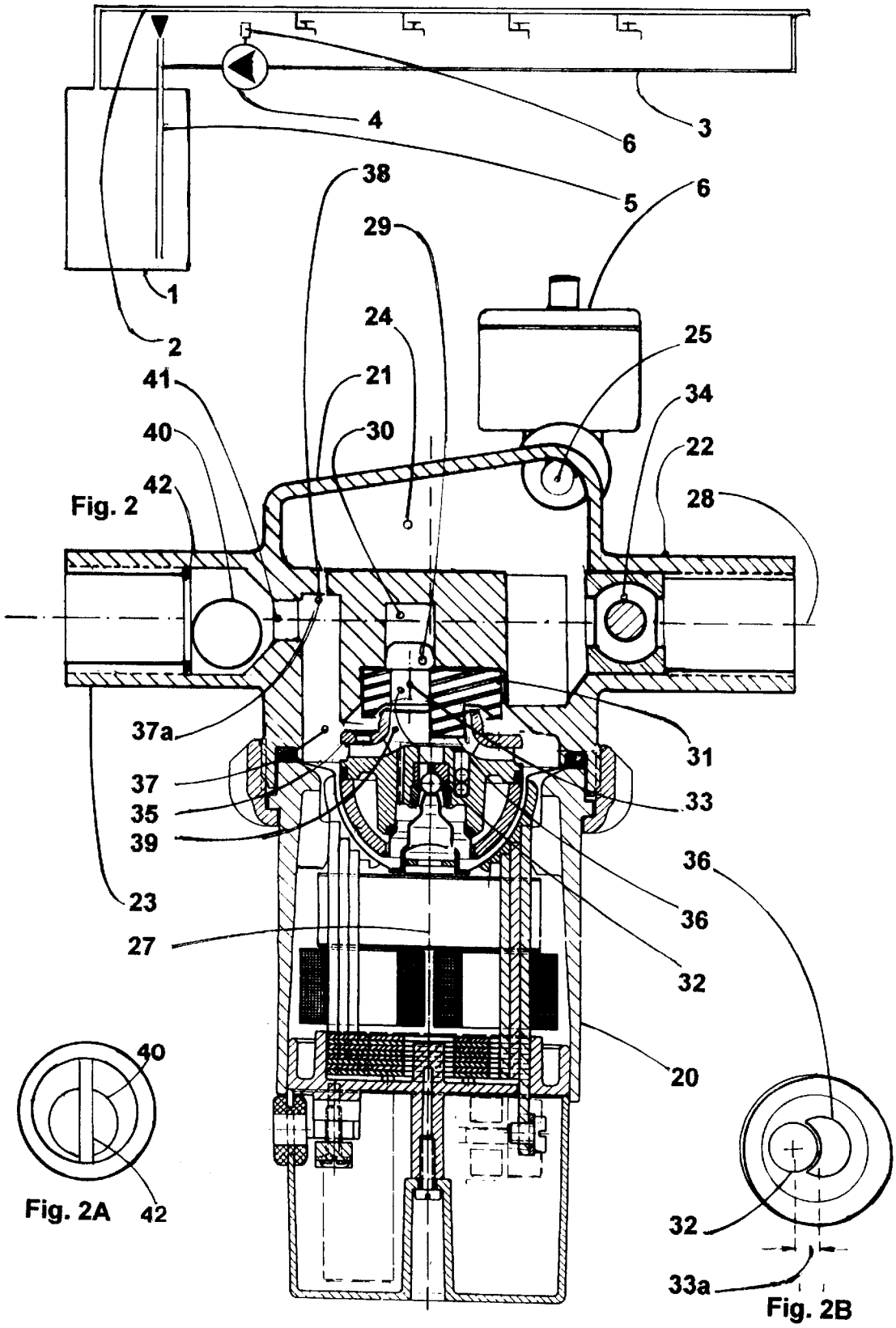
FIG. 1 shows an installation with a pump according to the invention.
FIG. 2 shows a vertical cross-section through the pump with vertical axis.
FIG. 2*a* shows the outlet port.
FIG. 2*b* shows a cross-section through the inlet port of the impeller.

FIG. 1 shows the hot water system with the hot water heater 1, the hot water supply line 2, the recirculation line 3 and the circulator pump 4, the pressure side of which communicates with the dip-tube 5 of the hot water heater 1. An air-vent 6 is attached to the pump.

FIG. 2 shows a vertical cross-section through the circulation pump. The motor axis 23 can run vertically, with the motor being below the pump, or horizontally. The pump housing 21 with an inlet port 22 and an outlet port has a calming chamber 24 in which gas-bubbles can rise. The opening 25 for the gas-bubbles is in an area, which always is at the highest level, whether the pump axis 23 runs vertically or horizontally. The opening 25 is connected to an air vent 6, that is rotatable around the axis of opening 25, so that it can be moved into a vertical position, for instance, when the axis 23 of the pump runs horizontally. After passing the calming chamber 24, the flow is conveyed through channel 29, into the cavity 30, which is closed by a plate 31. This plate 31 has a hole 32, whose axis 33 runs parallel and eccentrically to the axis of rotation 23, with a distance 33*a* from said axis. The flow passes through hole 32 into the suction region 39 of the pump impeller 35. Next to the hole 32 a vane 36 is positioned, which extends into the suction port 39 of the pump impeller 35. The pump impeller 35 is surrounded by a spiral channel 37, which is covered by a helically extending wall. The spiral channel ends at the outlet port. As a result of the hole 32 interacting with the vane 36, the pump impeller 35 creates an eccentric vortex that prevents further gas-bubbles, especially created by the centrifugal forces, from centripeding towards the axis 23. The eccentric vortex pushes the air bubbles into the spiral channel 37. At the end of channel 37, the gas-bubbles enter the calming chamber 24 through a narrow bore 38 in the highest region 37*a* of spiral channel 37, from where they exit to the outside through air-vent 6. The highest area 37*a* of the spiral channel 37 is also connected with the outlet port. A ball valve 34 is situated in the inlet port 22. A check-valve is positioned in the outlet-port that may consist for instance, of a ball 40, whose specific density differs from that of water, a valve-seat 41 and a barrier 42. The ball 40 allows the water to recirculate only in the direction of the hot water heater 1, while gas-bubbles can pass in the opposite direction as long as the ball 40 is in an eccentric position to the axis 28 of the pipe.

An eccentric vortex within the impeller can also be initiated by a protrusion in the spiral channel as known from self-priming centrifugal pumps.

When it is necessary to decalcify the pump, motor 20 can be unscrewed from the pump housing 21. The supply line will be closed by ball valve 34 within the inlet port 22, while on the pressure side, the outlet port will be closed by the check-valve.

FIG. 2*a* shows the ball 40 in its resting position within the outlet port as well as the barrier 42.

FIG. 2*b* shows the plate 31 in an enlarged presentation. The reference numbers are the same as in FIG. 2.

I claim:

1. In a domestic hot water circulation pump with a pump housing with inlet port and outlet port and an electric motor driving a pump impeller an improvement, wherein said pump housing (21) comprises a calming chamber (24) which communicates with an inlet port (22) and with an opening (25) at its highest point being connected with an air vent (6), the pump impeller (35) being surrounded by a spiral channel (37) which communicates with said outlet port and through a narrow bore (38) with said calming chamber (24).

2. Domestic hot water circulation pump according to claim 1, with means that extract air bubbles out of the periphery of the impeller.

3. Domestic hot water circulation pump according to claim 2, characterized in that a protrusion in the spiral channel (37) leads to the expulsion of air bubbles from the periphery of the impeller.

4. Domestic hot water circulation pump according to claim 2, characterized in that the suction region (39) of the pump impeller (35) forms a working clearance with the pump housing, and that the cross-section of the hole (32) is smaller than the cross-section of the suction region (39) of the pump impeller, and that the hole (32) lies eccentric to the axis of rotation (23).

5. Domestic hot water circulation pump according to claim 4, characterized in that a vane (36) positioned eccentrically to the axis of rotation extends into the suction port (39) of the pump impeller (35).

6. Domestic hot water circulation pump according to claim 1, characterized in that a check-valve is positioned within the outlet-port of the pump.

7. Domestic hot water circulation pump according to claim 6, characterized in that the check-valve comprises a ball (40), a valve seat (41) and a barrier (42).

8. Domestic hot water circulation pump according to claim 7, characterized in that the specific density of the ball (40) differs from the specific density of the water.

9. Domestic hot water circulation pump according to claim 1, characterized in that the spiral channel (37) is connected with the calming chamber (24) by more than one bore.

10. Domestic hot water circulation pump according to claim 1, characterized in that the air-vent (6) can be tilted around a horizontal axis.

* * * * *